US005761796A

United States Patent [19]

Imgrüt et al.

[11] Patent Number: 5,761,796

[45] Date of Patent: Jun. 9, 1998

[54] DEVICE FOR FITTING OUT CONNECTOR SHELLS

[75] Inventors: Peter Imgrüt, Buchrain; Guido Korner, Lucerne, both of Switzerland

[73] Assignee: Komax Holding AG, Meggen, Switzerland

[21] Appl. No.: 546,771

[22] Filed: Oct. 23, 1995

[30] Foreign Application Priority Data

Oct. 21, 1994 [CH] Switzerland ..... 03170/94

[51] Int. Cl.[6] ..... H01R 43/20; H01R 43/04

[52] U.S. Cl. ..... 29/748; 29/33 M; 29/754; 29/861; 29/863

[58] Field of Search ..... 29/33 M, 748, 29/753, 754, 861, 863

[56] References Cited

U.S. PATENT DOCUMENTS

| | | | |
|---|---|---|---|
| 4,916,811 | 4/1990 | Uehara et al. | 29/863 |
| 4,979,292 | 12/1990 | Fukuda et al. | 29/861 X |
| 5,127,159 | 7/1992 | Kudo et al. | 29/754 X |
| 5,414,925 | 5/1995 | Nishide et al. | 29/748 |

FOREIGN PATENT DOCUMENTS

| | | | |
|---|---|---|---|
| 576277 | 12/1993 | European Pat. Off. | 29/863 |
| 5234659 | 9/1993 | Japan | 29/863 |

*Primary Examiner*—Peter Vo
*Attorney, Agent, or Firm*—Hazel & Thomas

[57] ABSTRACT

The connector housings (1) to be fitted out are fed in succession along a feed track, and are then moved, by means of at least two grippers (19, 20), which are spaced apart in the advance direction and can be moved synchronously with one another, stepwise and individually in succession from a take-over position (FIG. 6*b*), along a connector housing guide and clamping track (12) into a fitting-out position (FIG. 6*g*, 6*h*), and are fitted out there with an electrical conductor, and are then moved by means of the respectively associated gripper along the guide and clamping track (12) into a release position (FIG. 6*c*). After release of the fitted-out connector housing (1) in the release position by the second gripper (19) and release of the connector housing (1) which is to be moved from the take-over position into the fitting-out position and is to be fitted out, by the other first associated gripper (20), the latter is moved back in a horizontal plane until it engages with a further connector housing (1), which is in the take-over position and is to be fitted out, and the second gripper (19) is moved back until it engages with the connector housing to be fitted out, which has been released beforehand by the first gripper (20), and these steps of the cycle are repeated in alternation.

15 Claims, 15 Drawing Sheets

A
B
C
12
13
14
15
17
18
21
22
23
24
25
26
27
28
29
29'
30
31
32
33
34

DEVICE FOR FITTING OUT CONNECTOR SHELLS

BACKGROUND OF THE INVENTION

The invention relates to a process for automatic assembly of connector housings with at least one electrical conductor optionally connected electrically to a contact component, and a device for carrying out the process.

Various processes and devices for assembling connector housings with individual conductors are already known, but they have the disadvantage that only very specific types of connector housings and assembly arrangements are suitable for them.

SUMMARY OF THE INVENTION

The object of the present invention is, therefore, to provide a process which does not have the abovementioned disadvantage and, e.g., at the end of a cable-processing line, allows fully automatic assembly of practically all known single-row or multi-row connector housings, regardless of whether by the crimping or cutting-clamping technique.

According to the invention, this object is achieved in a process of the above-mentioned type for automatic fitting out of connector shells with at least one electrical conductor optionally connected electrically to a contact component, characterized in that the connector shells to be fitted out are fed in succession along a feed track, are then moved, by means of at least two grippers, which are spaced apart in a subsequent advance direction and can be moved synchronously with one another, stepwise and individually in this advance direction in succession from a take-over position, along a connector shell guide and clamping track into a fitting-out position, and are fitted out there, in the position fixed by the guide and clamping track, with at least one electrical conductor, and are then moved by means of the particular associated gripper along the connector shell guide and clamping track into a release position, the distance between two successive grippers corresponding to half the distance between the take-over position and the release position, and, after release of the fitted-out connector shell in the release position by the second associated gripper and release of the connector shell, which is to be moved from the take-over position into the fitting-out position and is to be fitted out, by the other first associated gripper, the latter is moved back until it engages with a connector shell which is in the take-over position and is to be fitted out, and the second gripper is moved back until it engages with the connector shell to be fitted out, which has been released immediately beforehand by the first gripper, the movement being half the distance between the release position and the take-over position, and these steps of the cycle are repeated in alternation.

The invention furthermore relates to a device for carrying out the process according to the invention characterized by a) a feed arrangement (8) for feeding, in succession, connector shells (1) to be fitted out into a take-over position (10); b) at least two grippers (19, 20) which can be moved and actuated synchronously with one another and can be displaced along a connector shell guide and clamping track (12) from a starting or connector takeover position via a fitting-out position into an end or connector release position and, pushed back by this track (12), back into the starting or connector take-over position; c) a connector shell clamping arrangement (13) which is associated with the connector shell guide and clamping track (12), and is located and/or constructed such that it releases the connector shells (1) in this guide and clamping track (12) only during their displacement along this track (12), and the remainder of the time holds them firmly clamped, fixed in the their instantaneous position; and d) a fitting-out unit (7) for feeding at least one electrical conductor (3), optionally connected electrically conductively to a contact component (2), into a connector shell (1) fixed in the fitting-out position; the distance (T) between two successive grippers (19, 20, 66) corresponding to half the distance (2T) between the connector take-over position and the connector release position, and the grippers (19, 20, 66) being located and/or constructed such that, on reaching the common end position, they release the connector shells (1) gripped until then with these grippers and firmly clamped in the connector shell guide and clamping track (12), and can be moved back into the starting position together out of engagement with the said connector shells.

BRIEF DESCRIPTION OF THE DRAWINGS

The invention is explained in more detail by way of example below with the aid of the drawings, in which.

DETAILED DESCRIPTION OF THE PREFERRED EMBODIMENTS

Figure 1:
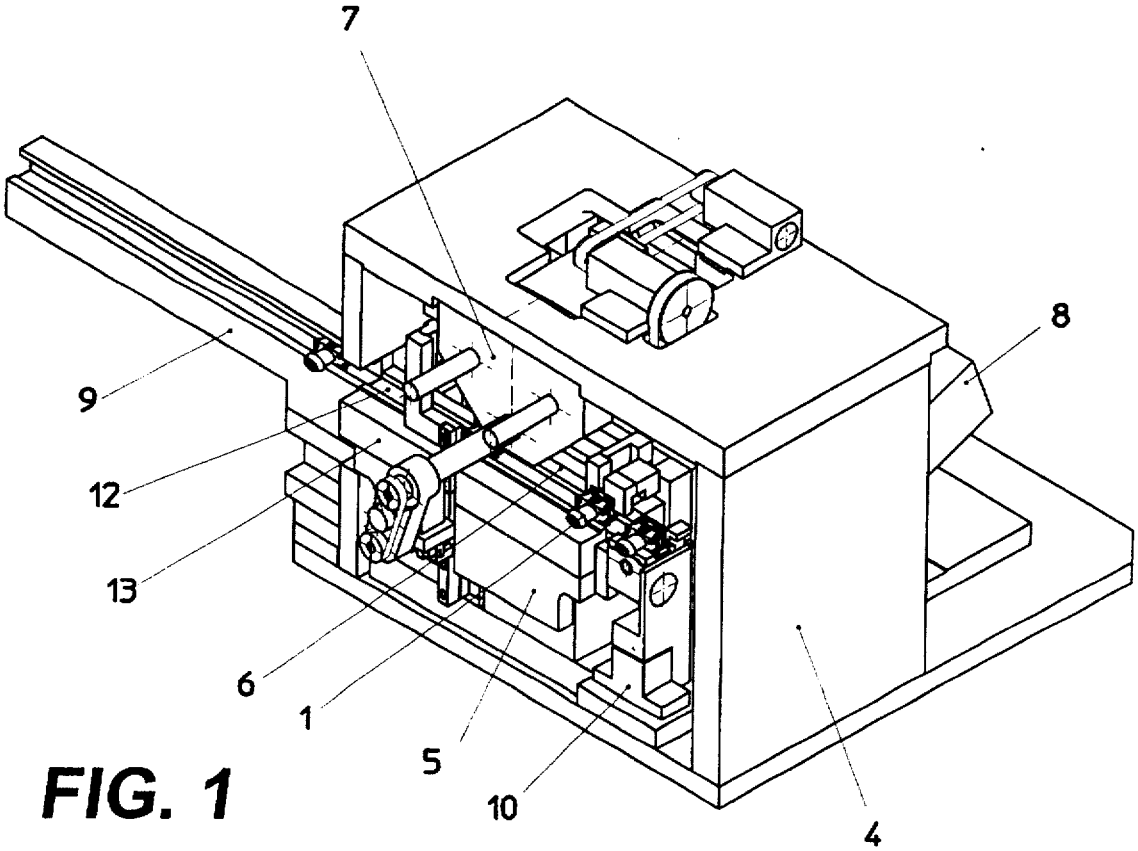
FIG. 1 shows a perspective view of a first embodiment, by way of example, of a device according to the invention.

As can be seen from FIG. 1, in particular, the device shown for automatic assembly of connector housings 1 with at least one electrical conductor 3 connected electrically to a contact component 2 (see, e.g., FIG. 7*a*) has a machine frame 4, a positioning unit 5 for positioning the connector housing 1 to be assembled along a connector shell guide and clamping track 6, an assembly unit 7, a connector housing feed arrangement 8 and an arrangement 9 which removes the assembled connector housing 1.

The housing feed and the housing removal arrangement 8 and 9 respectively are not described in more detail. Together with a take-over position 10, they form a component group 11 (FIG. 2) specific to the application, which can be constructed in very different ways, depending on the connector housings 1 to be processed, and therefore can be replaced as a common unit 11 for the fastest possible adaptability to other forms of connector housings and has a defined interface to the positioning unit 5.

Figure 8:
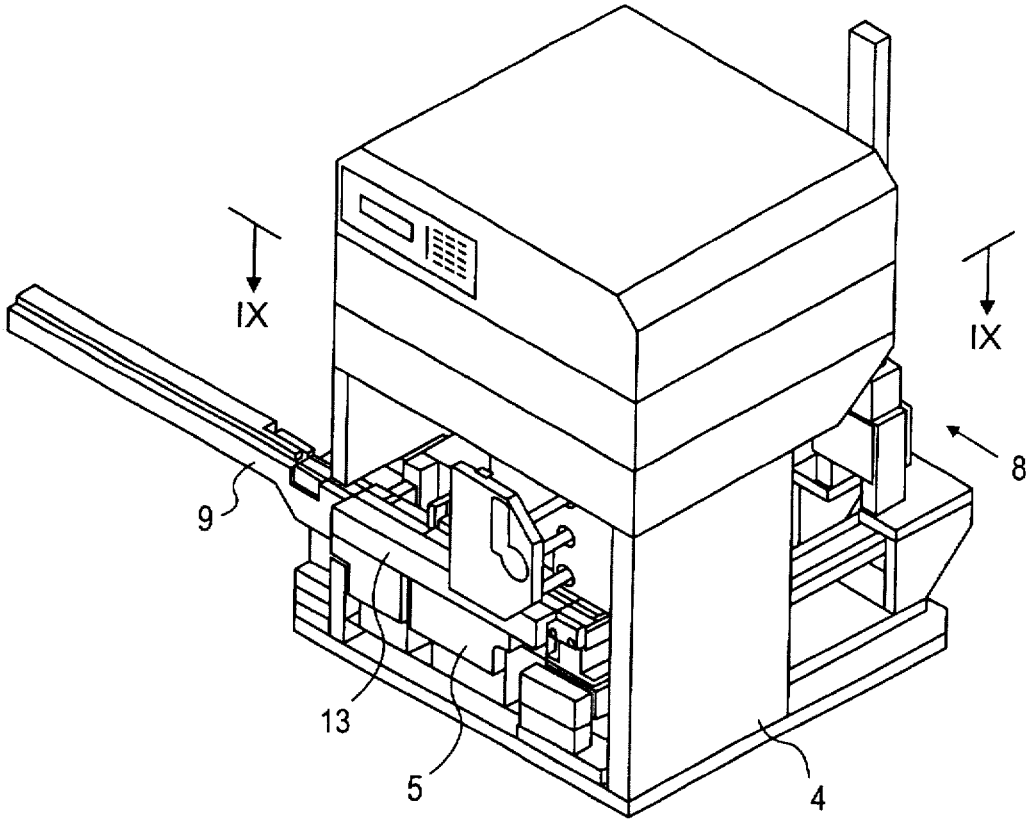
FIG. 8 shows a perspective view of a second embodiment, by way of example, of a device according to the invention.
Figure 8A:
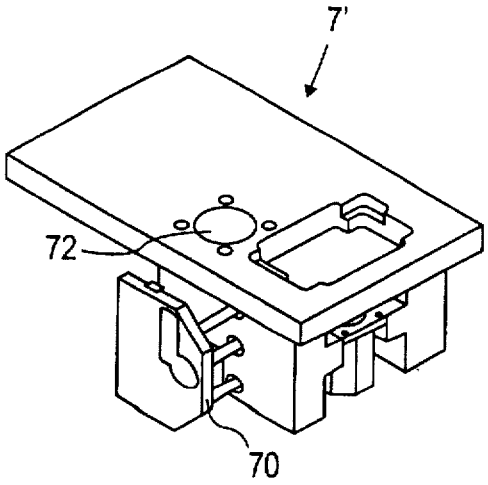
FIGS. 8*a*, 8*b* and 8*c* show a perspective view of various details of the device shown in FIG. 8.
Figure 8B:
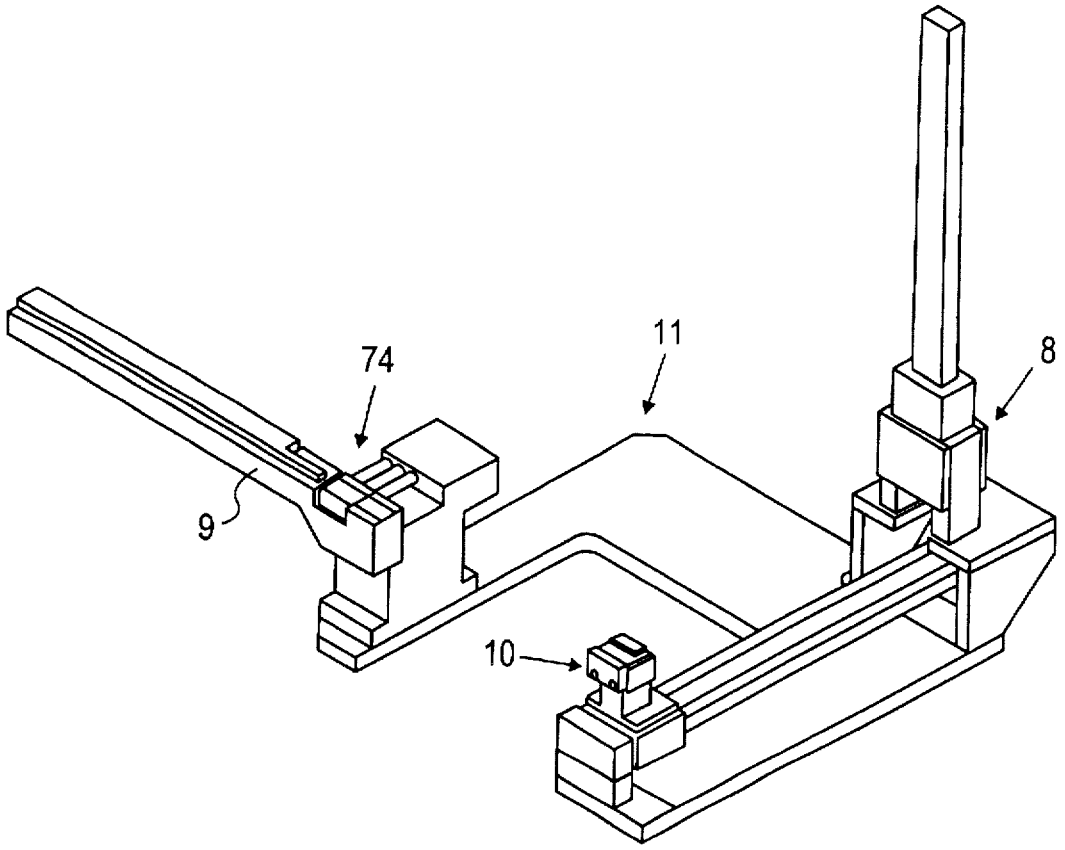
Figure 8C:
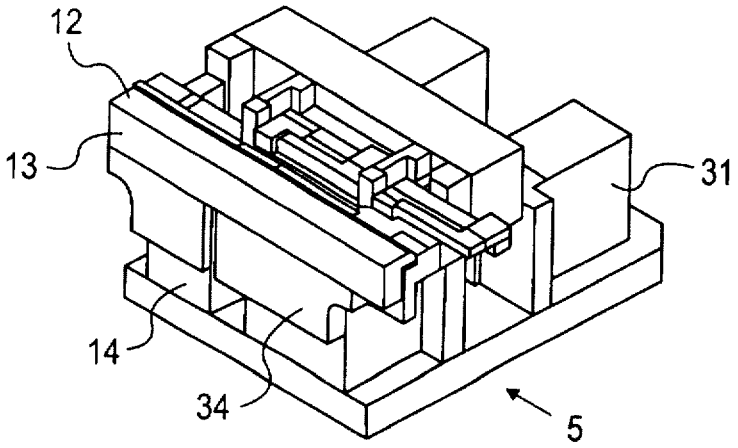

The positioning unit 5 has the task of taking over the empty connector housings 1 to be assembled from the takeover position 10 which forms part of the connector housing feed system, positioning them accurately at a plurality of places along a horizontal connector housing guide and clamping track 12 for assembly and, after assembly has taken place, subsequently feeding them to the removal arrangement 9. The same positioning unit 5 can also be used, as can be seen, e.g., from FIG. 8*c*, for a correspondingly modified device for processing conductors by the cutting-clamping technique (IDC). The construction and the mode of functioning of the positioning unit 5 remains the same in this case, but other operations are carried out with the IDC connector housings 1' to be assembled.

Figure 2:
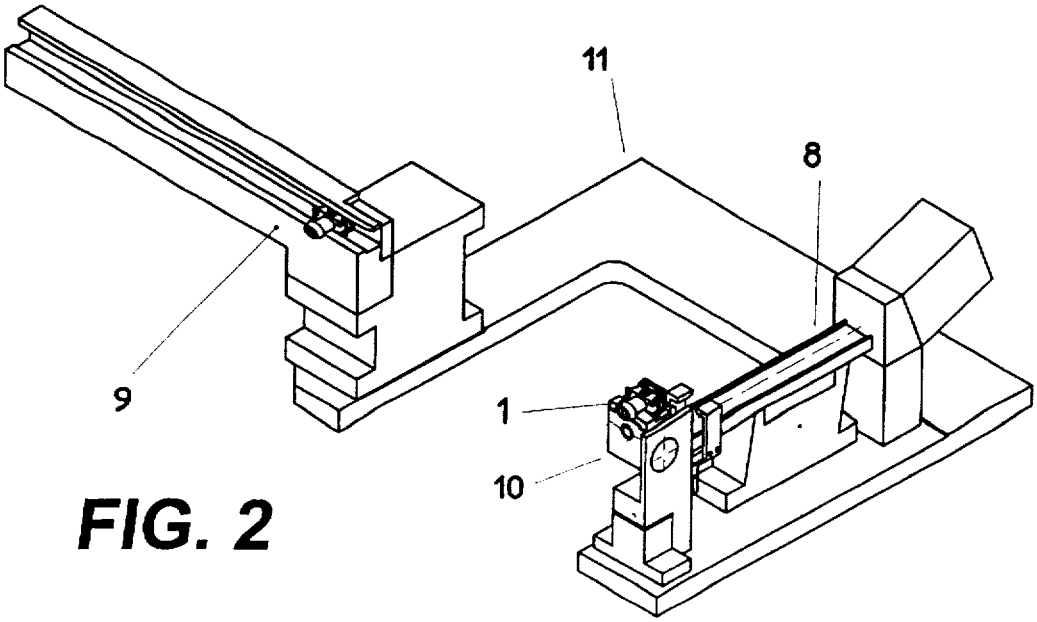
FIG. 2 shows a perspective view of the details of the device shown in FIG. 1.
Figures 3, 3A, 3B, 3C:
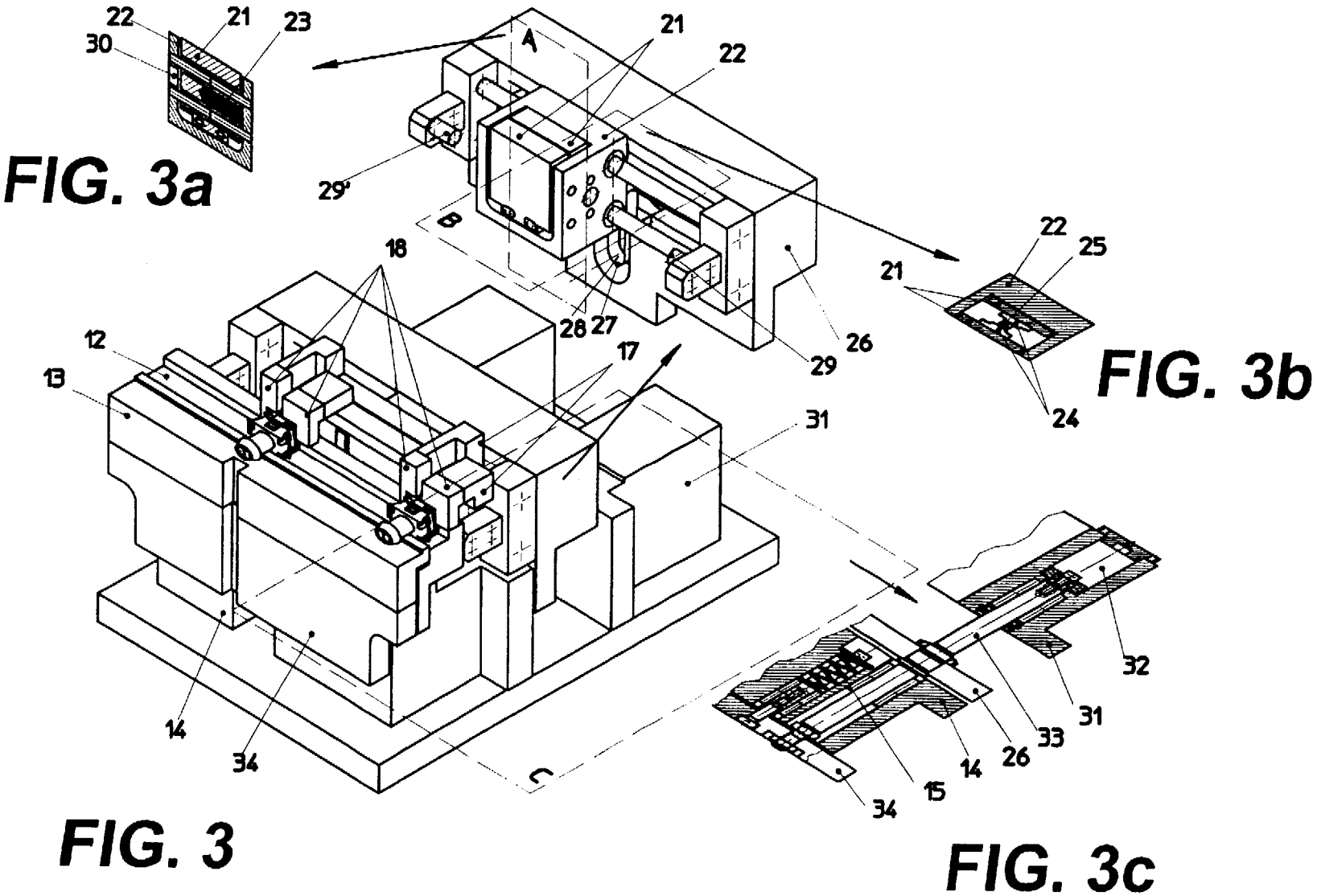
FIG. 3 shows a perspective view of the positioning unit of the device shown in FIG. 1.
FIGS. 3*a*, 3*b* and 3*c* show corresponding sections along the section planes A, B and C in FIG. 3.

As can be seen from FIG. 2 in particular, the positioning unit 5 has a connector housing guide and clamping track 12 which runs horizontally and is closed off at the front with a clamping plate 13 which can be moved in the horizontal direction, and thereby allows temporary controlled clamping of the connector housings 1 to be assembled in the guide and clamping track 12. The clamping plate 13 is guided in the front housing part 14 and is pretensioned against the inside of the guide and clamping track 12 by means of pressure springs 15.

Figure 6A:
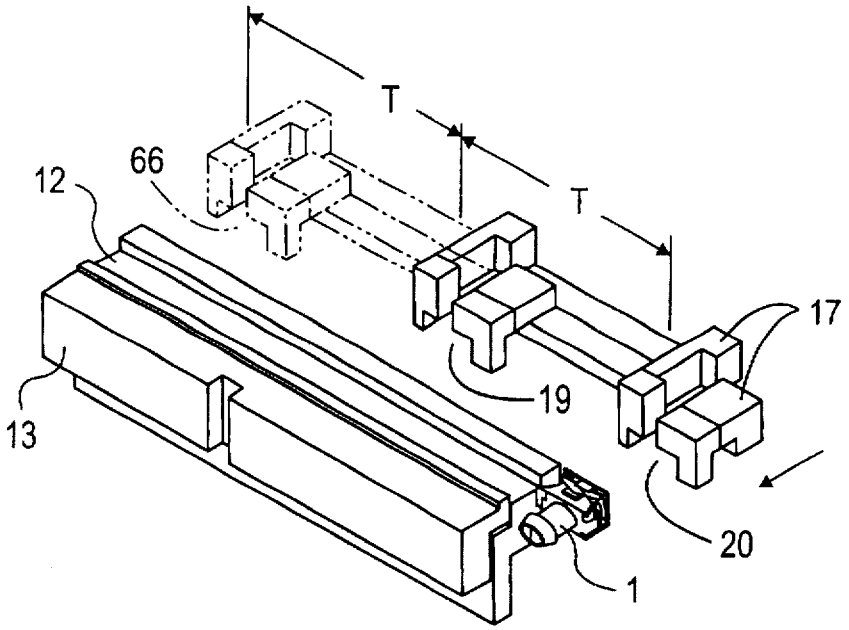
FIGS. 6*a* to 6*h* show a perspective view of the movement course of the gripper elements of the positioning unit of the device shown in FIG. 1.

The connector housing 1 is held and displaced in the guide and clamping track 12 by means of a comb-like gripper element 16 (see FIG. 6*a*). This gripper element 16 comprises two combs 17 which can be displaced relative to one another and which rigidly connect two or more left or right gripper fingers 18 to one another and thereby form two grippers 19 and 20. The two combs 17 are each fixed to a comb holder 21. The latter two are mounted in a carriage 22, displaceably parallel to the longitudinal axis of the guide and clamping track, and are pre-tensioned by means of pressure springs 23 such that the combs 17 move relative to one another and in this way clamp the connector housings 1 between the gripper fingers 18 of the grippers 19 and 20. So that the grippers close exactly centrally, they are coupled to one another positively by means of toothed racks 24 fixed to the comb holders 21 and a pinion 25 mounted in the carriage 22.

The carriage 22 with the combs 17 held therein together form the positioning carriage. This is in turn displaceable in a drive housing 26 parallel to the longitudinal axis of the guide and clamping track 12, and can be moved precisely with accurate control via the toothed belt 27 of a stepping motor 28 (not shown). Opening buffers 29 and 29' are located in each of the two end positions of the movement range of the positioning carriage. These two buffers 29 and 29' are located such that shortly before the end positions are reached, in each case through a bore 30 in the carriage 22, they halt in each of the two comb holders 21. Since the carriage 22 reaches its end position somewhat later, the second comb holder is displaced relatively against the direction of movement of the carriage 22 via the toothed racks 24 and the pinion 25. The two grippers 19 and 20 are thereby inevitably opened in the two end positions of the positioning carriage 22.

The drive housing 26, together with the positioning carriage and the stepping motor 28, can be displaced at a right angle to the guide and clamping track 12. Such a displacement is effected with the aid of two pneumatic cylinders 32 located in the rear housing part 31. The two piston rods 33 here are installed rigidly in the drive housing 26 and are mounted displaceably in the front and in the rear housing part 14 and 31 respectively. These piston rods 33, which are moved together with the drive housing 26, press against a top plate 34 in their front end position and thereby move the clamping plate 13 forwards, which has the effect that connector housings 1 in the guide and clamping track 12 are no longer fixed by clamping but are only fixed in their instantaneous position by means of the grippers 19 and 20.

The assembly unit 7 has the task of taking over the conductors 3 provided with contact components 2, e.g., from a cable-processing machine, and of inserting them into predetermined plug-in holes of the connector housings 1 provided by the positioning unit.

Figure 4:
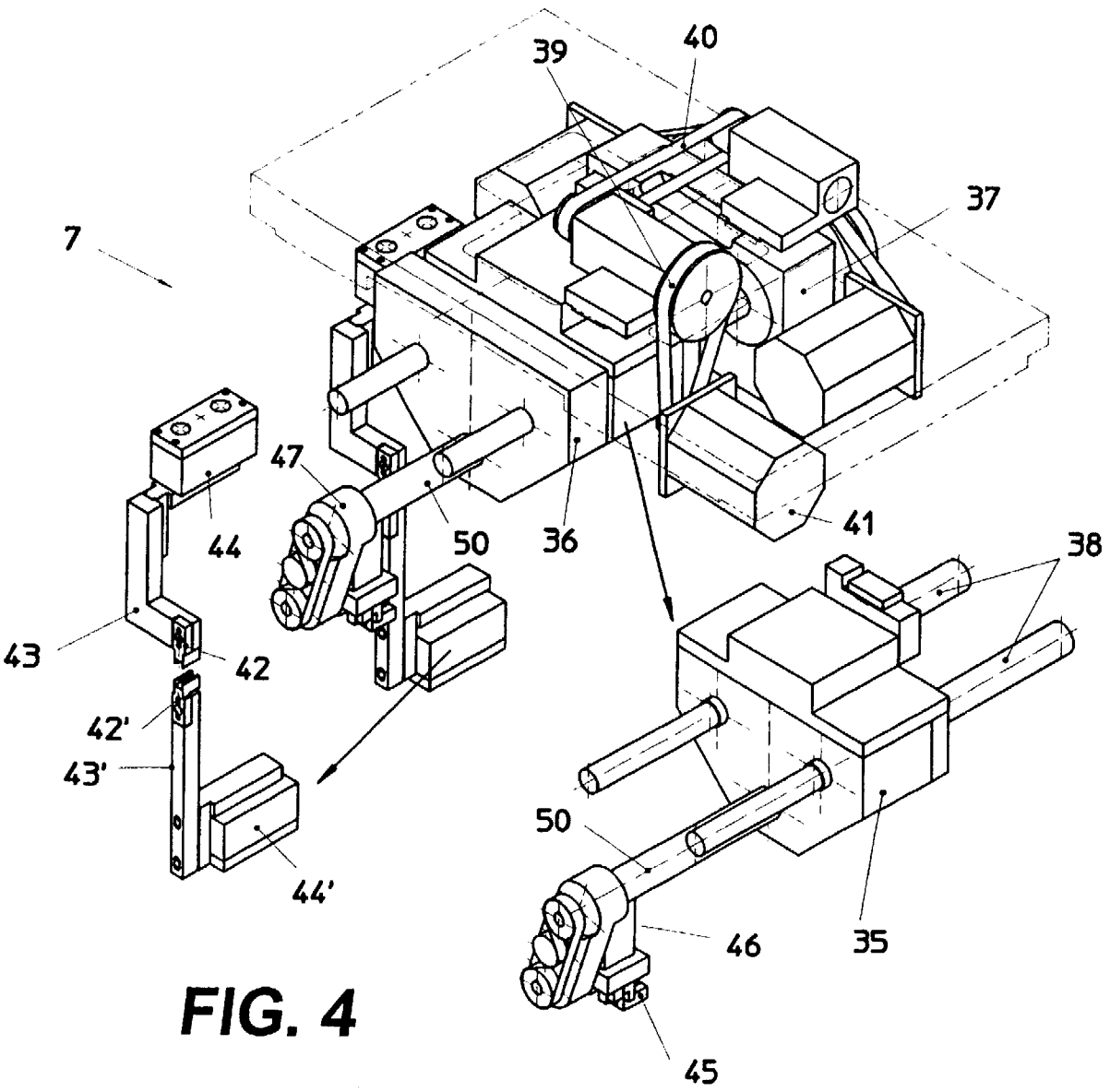
FIG. 4 shows a perspective view of the assembly unit of the device shown in FIG. 1.

For this, as can be seen in particular from FIG. 4, the assembly unit 7 has an assembly carriage 35 which, by means of two guide rods 38 mounted in the two bearing blocks 36 and 37, is mounted displaceably in the direction of the guide rods 38. This longitudinal displacement is effected with accurate control by a stepping motor 41 which acts on the two toothed belts 39 and 40. The two centering grippers 42 and 42' are moved centrally in the opening and closing position via the connecting rods 43 and 43' from the pneumatic cylinders 44 and 44'.

The assembly carriage 35 performs all the movements necessary for insertion of a conductor 3 and the contact component 2 thereof into a particular plug-in hole of a connector housing 1 to be assembled.

Figures 5, 5A, 5B, 5C:
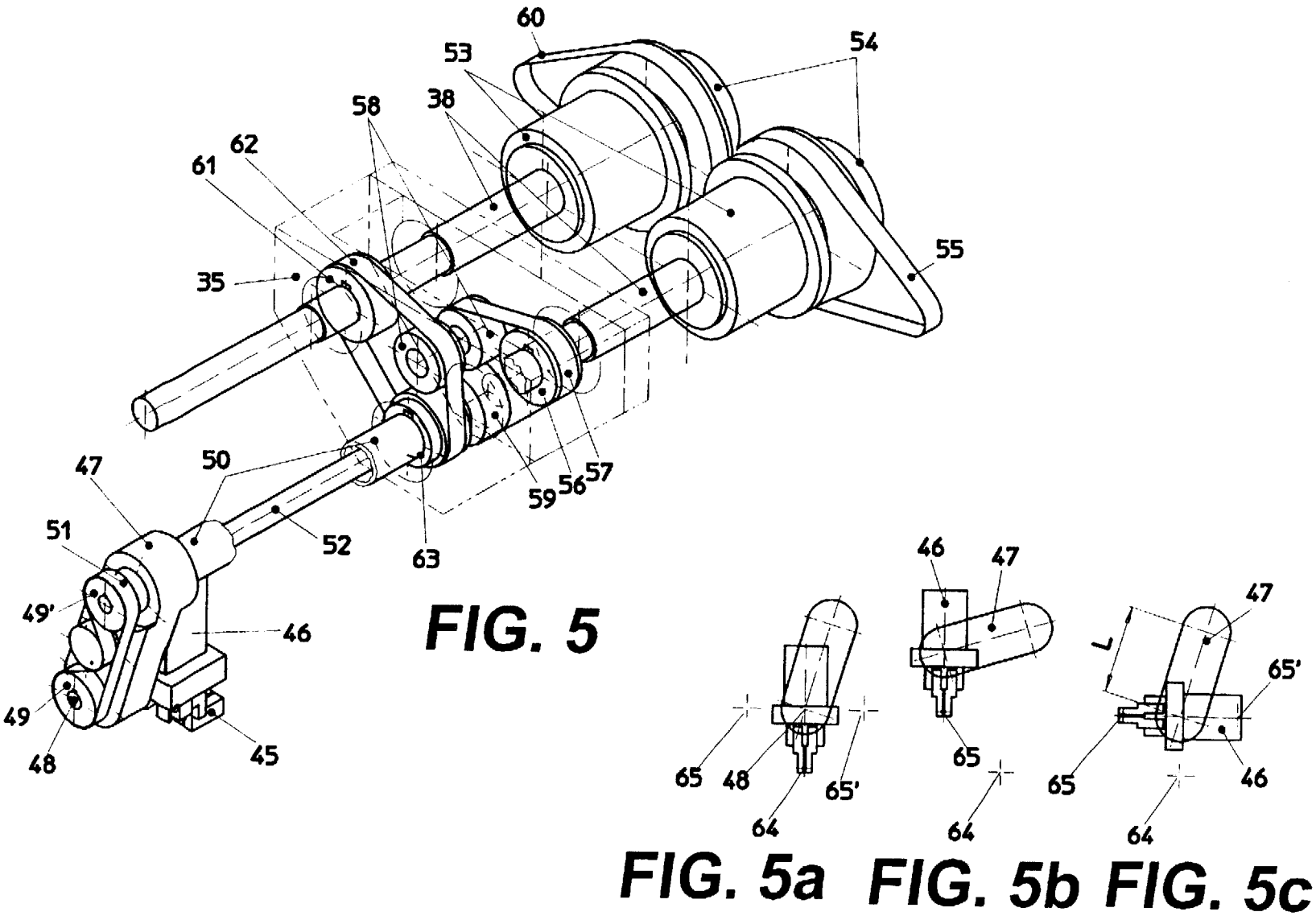
FIG. 5 shows a perspective view of the drive of the gripper element of the device shown in FIG. 1.
FIGS. 5*a*, 5*b* and 5*c* show various assembly positions of the gripper element.

As can be seen from FIG. 5 in particular, for this the conductor 3 is held by the gripper jaws 45 of a cable gripper 46. The cable gripper 46 is mounted rotatably, in a swivel arm 47, about the rotational axis 48 of a toothed pulley 49. The swivel arm 47 in turn is connected rigidly to a hollow shaft 50, which in turn is mounted rotatably in the assembly carriage 35. A rotational movement of the cable gripper 46 is effected by driving via the toothed pulleys 49 and 49', which are connected to one another via a toothed belt 51 and are driven by a rotary shaft 52 mounted rotatably in the hollow shaft 50. The guide shafts 38 are mounted rotatably in the assembly carriage 35. They lie in spherical liners 53 which allow linear displacement of the assembly carriage 35 and at the same time also transmission of a rotary movement from the toothed pulleys 54 to the guide shafts 38. The spherical liners 53 and the guide shafts 38 are commercially available bought-in components. The spherical liners 53 are mounted rigidly in the rear housing part 37 and do not move with the assembly carriage 35.

The right-hand guide shaft 38 can be rotated via the toothed belt 55 by means of a stepping motor (not shown), which causes a rotary movement of the toothed pulley 59 via the toothed pulley 56, the toothed belt 57 and a tension roller 58. Since the pulley 59 is connected rigidly to the rotary shaft 52, this causes rotation of the cable gripper 46.

Analogously to this, the swivel arm 47 can be swivelled with extremely precise control by means of a stepping motor (not shown) engaged with a toothed belt 60. In this way, the toothed belt 60 acts on the left-hand guide shaft 38, the toothed pulley 61, the toothed belt 62, the toothed pulley 63 and the hollow shaft 50 connected rigidly to the latter.

Since the toothed pulleys 49 and 51 have the same number of teeth, the cable gripper 46 always remains parallel to its starting position during a swivel movement of the swivel arm 47 with the rotary shaft 52 idle (see FIGS. 5*a* and 5*b*).

Figure 7A:
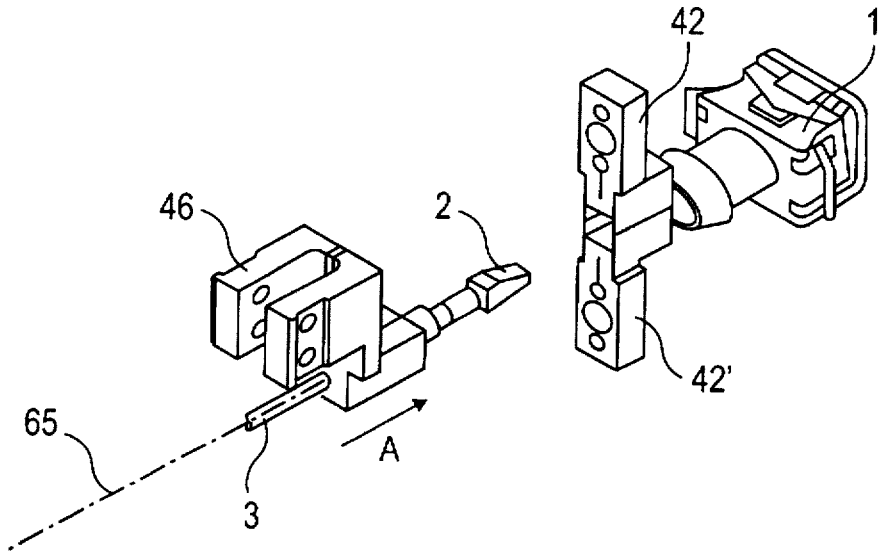
FIGS. 7*a* to 7*e* show a perspective view of the individual steps of the assembly operation.

Before the actual assembly of a connector housing 1 in the assembly position, the conductor 3 provided with the contact component 2 is taken over from the cable-processing machine and raised from a take-over axis 64 to a assembly axis 65 (see also FIG. 7*a*). For this purpose, the cable gripper 46 clamps the conductor 3 in the position of the assembly carriage 35 extended out towards the conductor 3 (Fig. 5*a*). The conductor 3 can be raised to the assembly axis 65 here in two different ways. In the first variant (Fig. 5*b*), the contact component 2 retains its alignment unchanged, while in the second variant (FIG. 5*c*) the conductor 3 and therefore also the contact component 2 is rotated by 90° about its longitudinal axis. As a result of the specific geometric design of the swivel arm 47 and of the cable gripper 46, the same displacement of the conductor 3 results in both cases. In the case of parallel displacement of the conductor 3 (FIG. 5*b*), only the swivel arm 47 swivels, with the rotary shaft 52 idle, while in the case of a rotation by 90° (FIG. 5*c*), only the cable gripper 56 rotates, with the swivel arm 47 idle, which is an extremely expedient solution.

If in an arrangement according to Fig. 5*a* with respect to the cable gripper rotational axis 48 a second assembly axis 65', symmetrical with the assembly axis 65, of a second assembly position is provided, it is possible for a conductor 3 which is to be inserted into a connector housing 1 to be rotated by 90° in one or the opposite direction of rotation before the insertion. Since the connector housings 1 to be assembled can be displaced and positioned backwards and forwards as desired along the guide and clamping track 12 with the aid of the grippers 19 and 20, it is easily possible here, e.g., first to insert a contact component 2, rotated by 90°, along the assembly axis 65 (Fig. 5*c*) into one plug-in hole to be assembled in a connector housing 1, then to displace the latter back again along the guide and clamping track 12 until a second plug-in hole to be assembled in this connector housing 1 is aligned with the second assembly axis 65', and then to insert another contact component 2, rotated by 180° with respect to the first contact component inserted, into the same connector housing.

The course of the positioning operation will be illustrated below with the aid of FIGS. 6*a* to 6*h*. In these, in FIG. 6*a*, a possible construction of the gripper arrangement with three grippers 19, 20 and 66 is shown as a broken line. Such a construction is advantageous if, e.g., in a test station further to the left of the guide and clamping track 12 in FIG. 6*a* to 6*h*, in addition a connector housing 1 just assembled is to be checked electrically, a connector housing cover is to be closed or a connector housing 1 is also to be printed on.

In FIG. 6*a*, the gripper element 16 is in its right-hand base position. The drive housing 26 is in the rear position, and the feed system has placed a connector housing 1 to be assembled in the take-over position 10. Since the carriage 22 is engaged with the right-hand end buffer 29, the grippers 19 and 20 are opened under the influence of the latter.

Figure 6B:
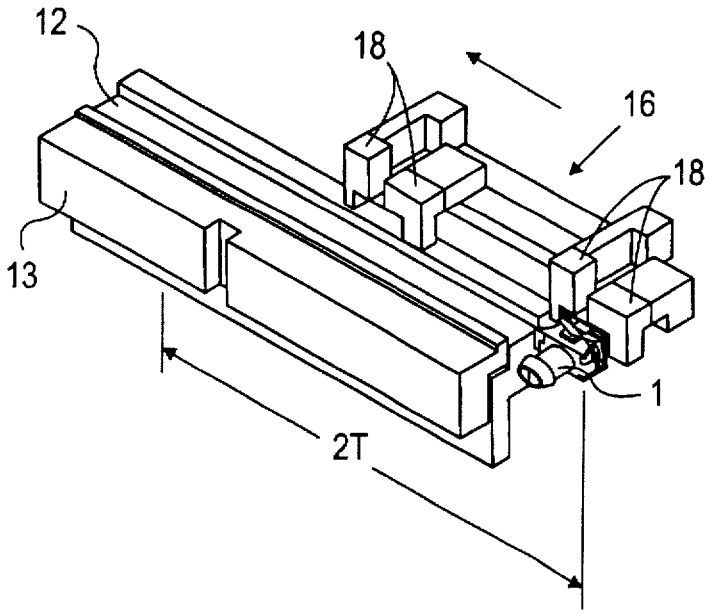

In FIG. 6*b*, the gripper element 16 is in the take-over place for taking over the connector housing 1 in the takeover position 10, and the drive housing 26 is in the front position, whereby the clamping plate 13 releases the guide and clamping track 12.

Figure 6C:
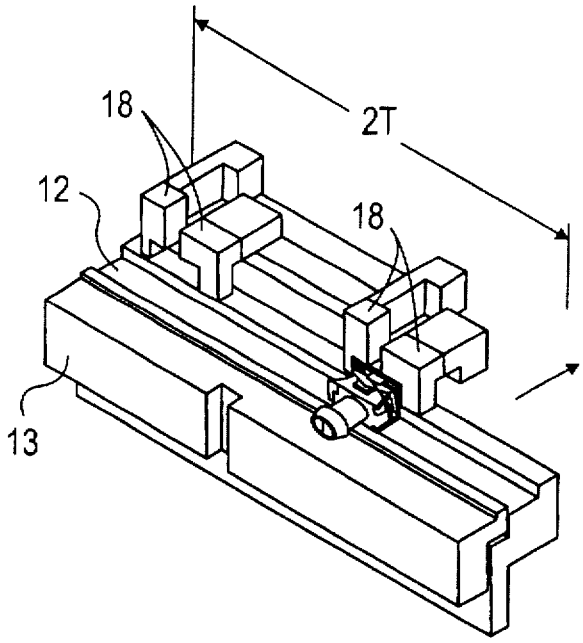

In FIG. 6*c*, the gripper element 16 is in its end or connector housing release position. The carriage 22 is in its left-hand end position, engaged with the left-hand end buffer 29', whereby the grippers 19 and 20 are opened under the influence of the latter. The connector housing 1 to be assembled and gripped beforehand by the gripper 20 in the take-over position 10 has also been moved to the left in the guide and clamping track 12.

Figure 6D:
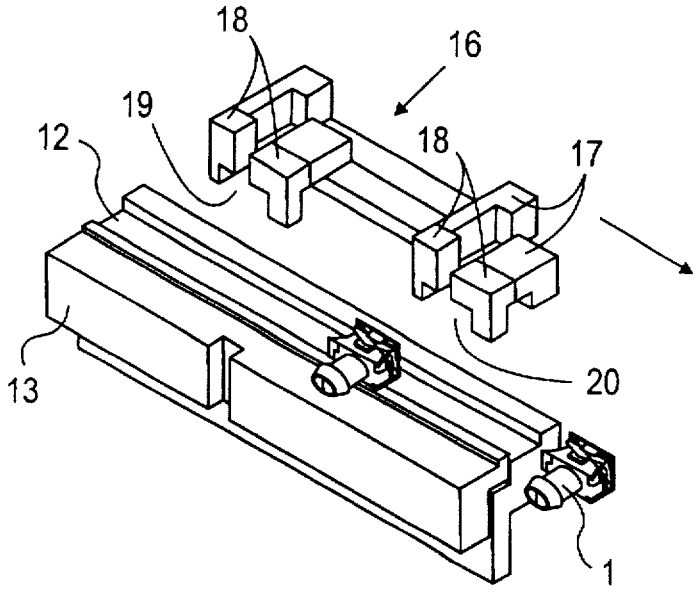

In FIG. 6*d*, the gripper element 16 is in its left-hand rear base position, i.e., the drive housing 26 is in the rear position. Immediately after the drive housing 26 leaves its front position, the clamping plate 13 is released and the connector housing 1 in the guide and clamping track 12 is thereby firmly clamped in its instantaneous position. This ensures that the connector housing 1 in this track 12 cannot be displaced.

Figure 6E:
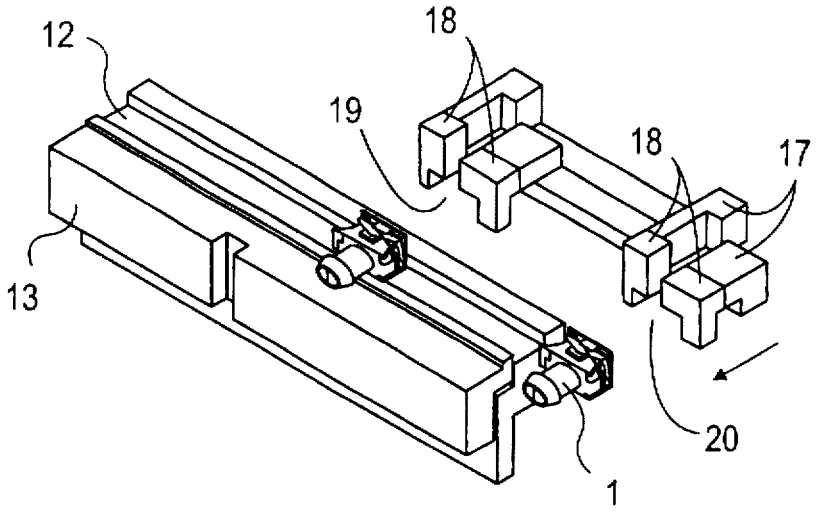

In FIG. 6*e*, analogously to the position shown in FIG. 6*a*, the gripper element 16 is again in its right-hand rear base position, and the feed system has meanwhile placed a second connector housing 1 to be assembled in the take-over position 10. During the return movement of the carriage 22 from the left-hand to the right-hand end position, the grippers 19 and 20 were in the closed position, but this is of no significance, since they are not engaged with the connector housing 1 in the guide and clamping track 12.

Figure 6F:
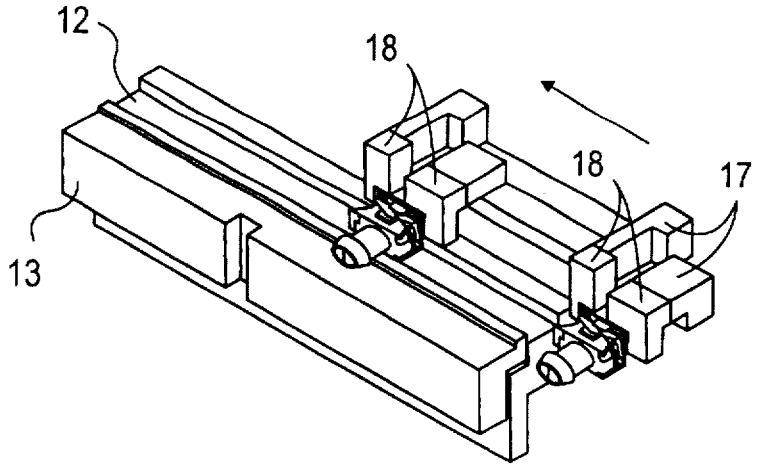
Figure 6G:
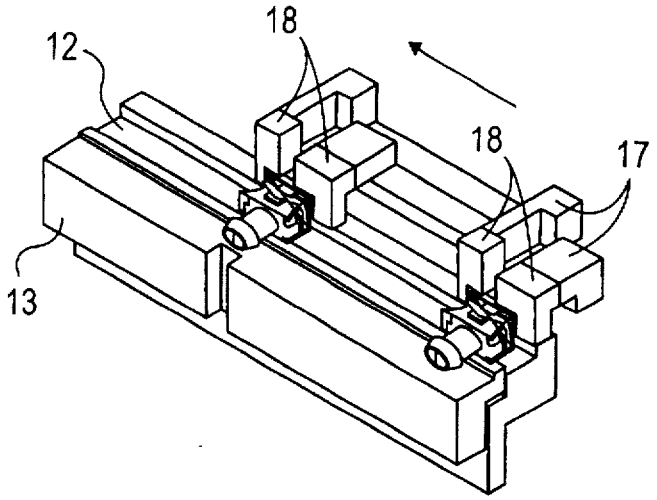

In FIG. 6*f*, the gripper element 16, again analogously to the position shown in FIG. 6*b*, is in the take-over position for taking over the second connector housing 1 in the take-over position 10 by the gripper 20 and for grasping of the first connector housing 1, which is in an intermediate position, by the gripper 19, and the drive housing 26 is here again in the front position. Immediately before the drive housing 26 reaches its front position, the stop on the two connector housings 1 by the clamping plate 13 is cancelled automatically. In FIG. 6*g*, the gripper element 16 is in a first assembly position.

In its prior displacement to the left, the carriage 22 was disengaged from the right-hand end buffer 29, which means that the grippers 19 and 20 were automatically closed centrally and the connector housings 1 enclosed by these two grippers were firmly clamped by these. The two connector housings 1 are now each in a precisely defined position. For applications which require several sequential operations (e.g., process monitoring), it is thus possible to carry out different operations simultaneously, at two positions separated from one another, on the connector housings to be assembled. By increasing the number of grippers (see e.g. FIG. 6*a*), more than two parallel processing operations are even possible.

Figure 6H:
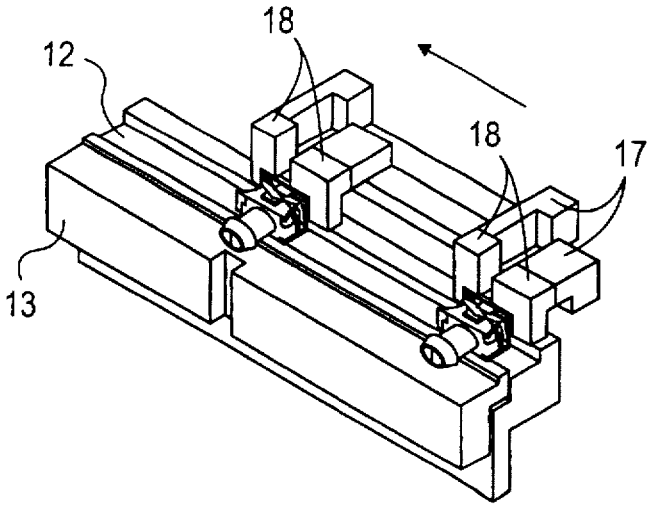

In FIG. 6*h*, the gripper element 16, e.g., for assembling a second plug-in hole of a connector housing is in a second assembly position removed from the first assembly position (FIG. 6*g*) by the distance between holes. Depending on the number of poles and the distance between the poles of the connector housing to be processed, other further processing positions can also subsequently be arrived at if required.

From this assembly position shown in FIG. 6*h*, the gripper element 16 is then moved into the left-hand end position which can be seen from FIG. 6*c*, the finished assembled connector housing 1 grasped by the left-hand gripper 19 is released there, and the steps of the cycle which can be seen from FIG. 6*c* to 6*h* are repeated in alternation, so that finished connector housings 1 are pushed progressively to the left out of the guide and clamping track 12.

The actual assembly operation is explained in more detail below as a sequence of steps with the aid of FIGS. 7*a* to 7*e*.

FIG. 7*a* shows the starting position, in which the assembly unit 7 has raised the conductor 3, provided with a contact component 2, from a lower-lying take-over position to the assembly axis 65. The contact component 2 here is in front of the closed centering gripper 42, 42', which is placed immediately in front of the connector housing 1 to be assembled, and ensures accurately centered insertion of the contact component 2 into the plug-in hole to be assembled in the connector housing 1.

Figure 7B:
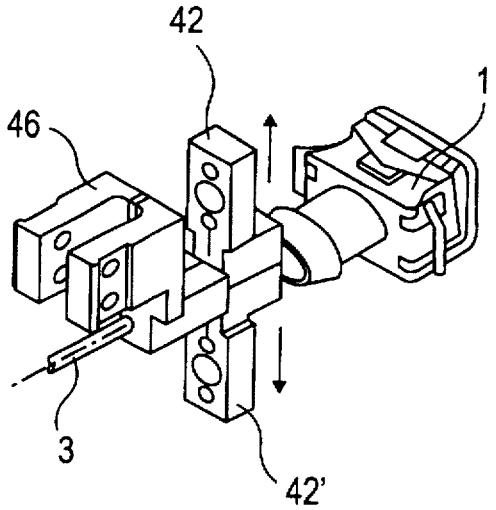

FIG. 7*b* shows the centering operation. By the longitudinal displacement of the assembly carriage 35 in the direction of the connector housing 1, the contact component 2 is pushed by the closed centering gripper 42, 42' into the entry of the plug-in hole to be assembled in the connector housing 1. The internal contour of the centering gripper 42, 42' matches the outer shape of the contact component 2 crimped on the conductor 3 and allows precise insertion into the plug-in hole to be assembled. The length of the centering gripper and therefore the length of the assembly path taken depends on the geometry of the plug-in hole and of the contact component 2. The assembly movement A is interrupted when the cable gripper 46 is immediately in front of the centering gripper 42, 42'.

Figure 7C:
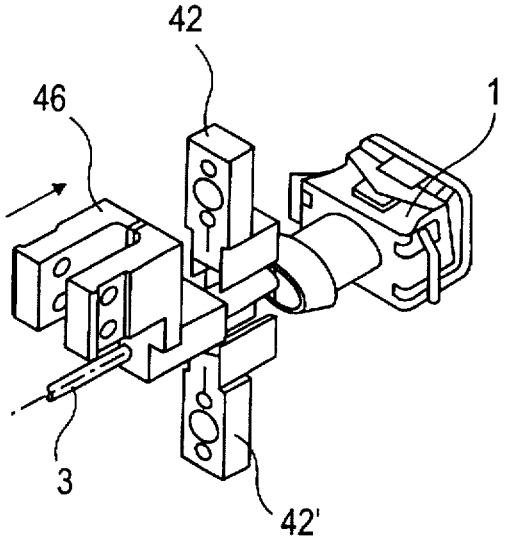

Thereafter, as can be seen from FIG. 7*c*, the centering gripper 42, 42' is opened, and the assembly axis is thereby released for further movement of the cable gripper 46 in the fitting-out direction A. Such a stepwise assembly movement is necessary in order to hold the conductor 3 as close as possible to the contact component 2 and thereby to reduce the risk of kinking the conductor 3.

Figure 7D:
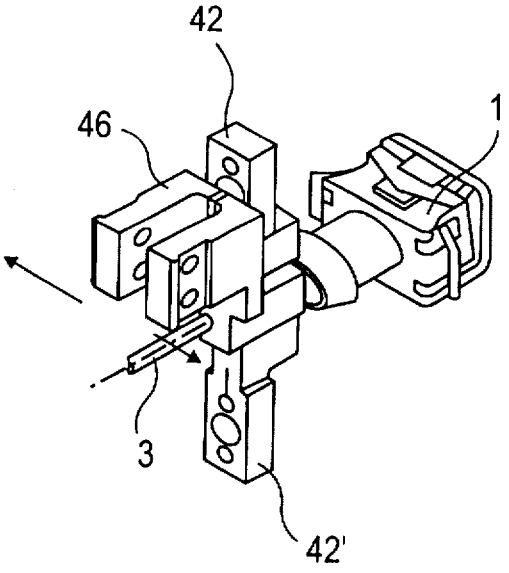

The actual assembly process can be seen from FIG. 7*d*. The cable gripper 46 is moved further in the direction of the connector housing 1, until the end position of the contact component 2 in the plug-in hole to be assembled in the housing 1 is reached. As a rule, the plug-in holes of the connector housings are constructed such that a contact component 2 snaps into them. In an intermediate step, this snapping in can be checked by a procedure in which a test movement is made away from the connector housing 1 with the cable gripper 46 closed and the withdrawal force of the contact component 2 is checked with suitable means (e.g. pneumatically or by a reduction in the current of the stepping motor feed), and if appropriate an error signal is emitted.

Figure 7E:
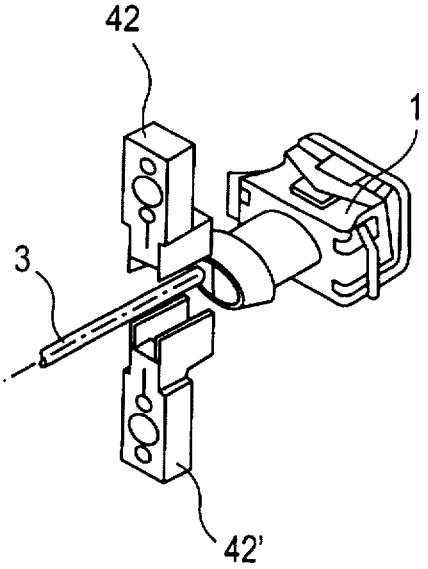

After assembly has been concluded, as can be seen from FIG. 7*e*, the cable gripper 46 is opened and the conductor 3 is released. The assembly carriage 35 then moves the cable gripper 46 back again into its take-over position, and the centering gripper 42, 42' closes as soon as the positioning unit 5 has moved the connector housing 1 further by one step of the cycle.

All the control operations are connected to one another and can be programmed via microprocessor control. A second embodiment, given by way of example, of a device according to the invention for assembling connector housings 1' provided with cutting-clamping contacts (IDC) is described below with the aid of FIGS. 8 to 11, components analogous to the first embodiment example being given the same reference numerals, so that another description of such analogous components is unnecessary. In this second embodiment example, in principle only the assembly unit 7' is constructed differently from the first embodiment example, in order to be able to carry out two sometimes completely different assembly processes with a maximum of identical components.

Figure 9:
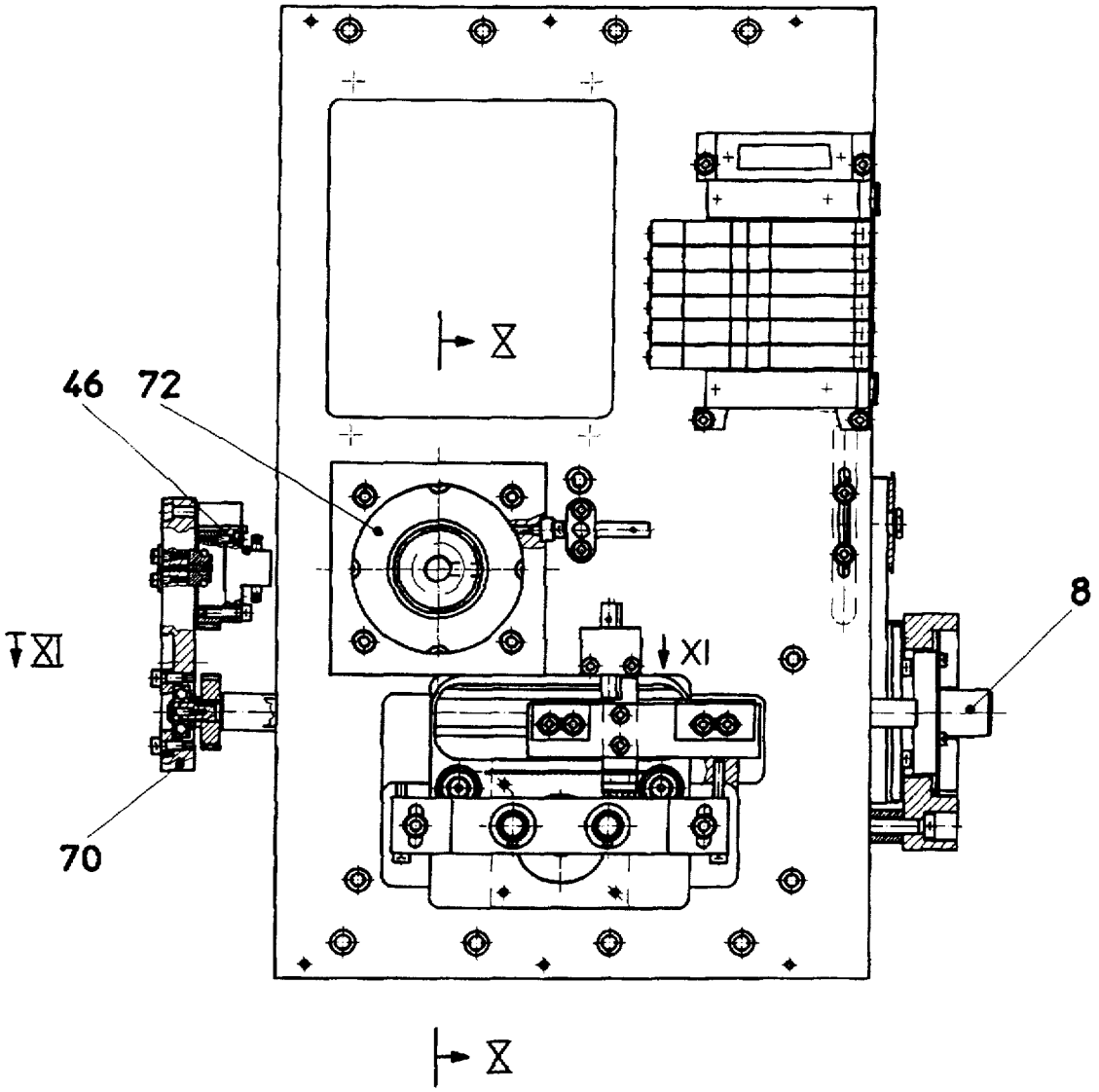
FIG. 9 shows a plan, along the line IX—IX, of the device shown in FIG. 8.
Figure 10:
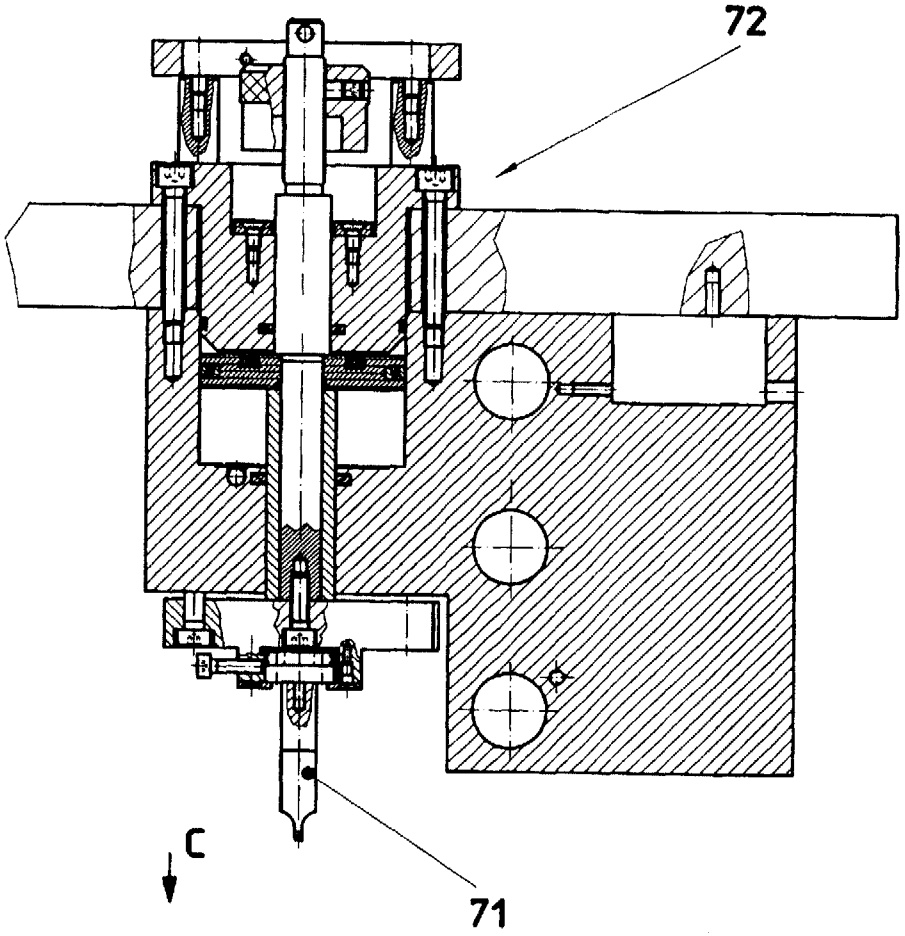
FIG. 10 shows a section along the line X—X in FIG. 9.
Figure 11:
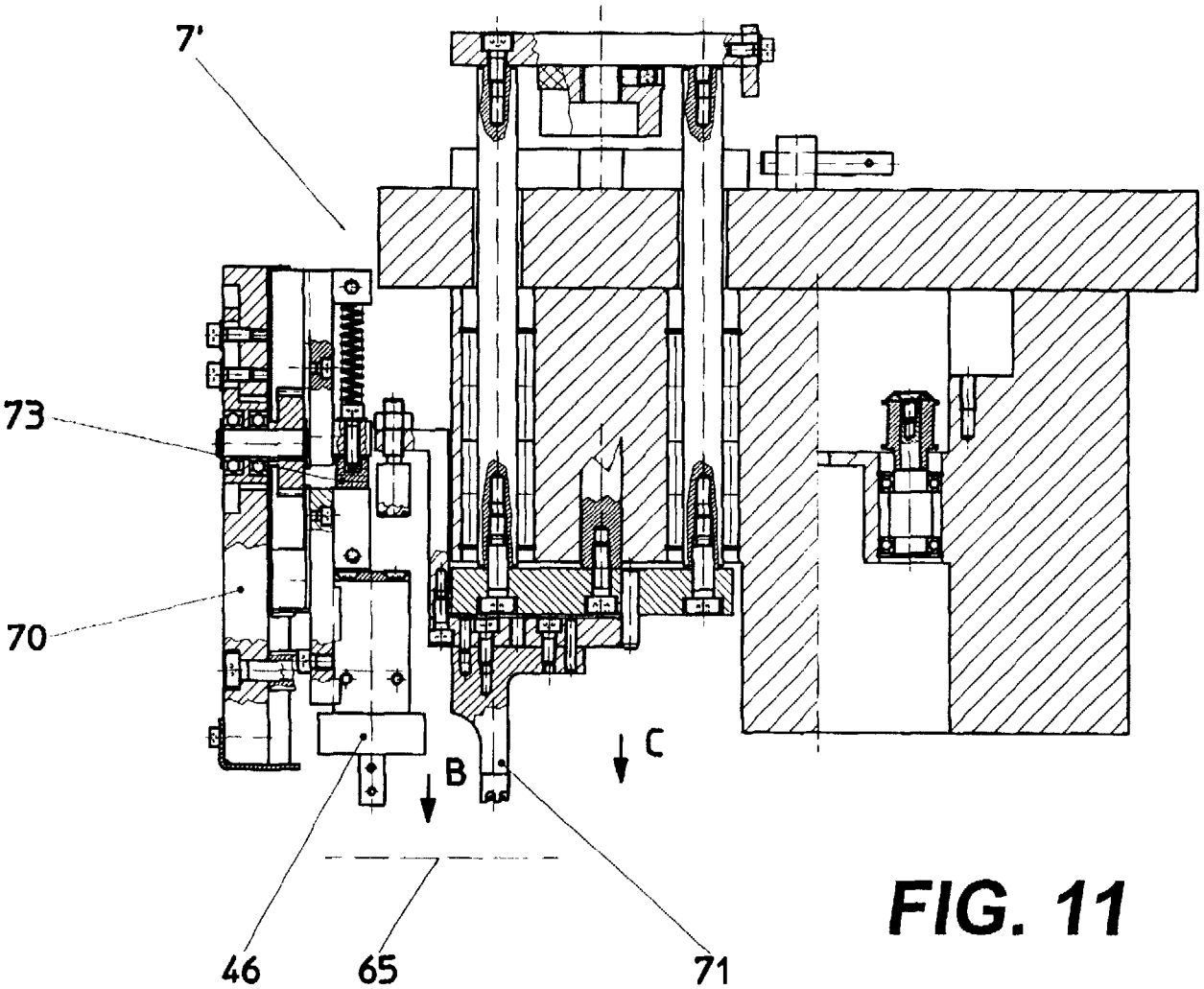
FIG. 11 shows a section along the line XI—XI in FIG. 9.

As can be seen in particular from FIGS. 9 and 11, the cable gripper 46 of the assembly unit 7' can be displaced perpendicularly to the connector housing guide and clamping track 12 and parallel to the assembly direction 65, and can be displaced in a controlled manner, by means of a stepping motor (not shown), by a precisely determined amount parallel to the assembly direction 65, the latter running immediately above the cutting clamping contacts to be assembled, so that insertion of a conductor 3, unimpeded by the contacts, down to the desired insertion depth is rendered possible.

The cable gripper 46 is supported displaceably in the conductor lowering direction B against the action of a pressure spring in the platen 70 of the assembly unit 7. Furthermore, in the assembly position, a pressing unit 72 connected to a press-in plunger 71 is provided above the connector housing guide and clamping track 12 in order to press a conductor 3 immediately above the cutting-clamping contacts of a connector housing to be assembled into these contacts in a known manner. The pressing unit 72 cooperates here, when viewed in the pressing direction C, with a buffer 73 of the cable gripper 46, which can be displaced parallel thereto and is spring mounted in the assembly unit 7, so that after the press-in plunger 71 has been lowered down to the upper side of the conductor 3 to be pressed in, the cable gripper 46 is simultaneously lowered parallel to the press-in plunger 71 during the subsequent pressing-in operation on the conductor, and the conductor 3 is thereby held absolutely horizontal over the entire pressing-in length during the pressing-in operation, in order to achieve an optimum course of the assembly.

While the invention has been described in connection with one of its preferred embodiments, it should be understood that changes and modifications may be made without departing from the spirit and scope of the appended claims.

We claim:

1. A device for automatic assembly of connector housings, comprising a feed arrangement for feeding, in succession, connector housings to be assembled into a take-over position; at least first and second grippers which are movable and actuated synchronously with one another and displaceable along a connector housing guide and clamping track from a connector take-over position via an assembly position into a connector release position and, pushed back by said clamping track into the connector take-over position; a connector housing clamping arrangement operatively connected to the connector housing guide and clamping track, and positioned such that the arrangement at least one of releases the connector housings in this guide and clamping track only during their displacement along said clamping track and holds the connector housings firmly clamped, fixed in their instantaneous position; and an assembly unit for feeding at least one electrical conductor into a connector housing fixed in the assembly position, a distance (T) between the first and second grippers corresponding to half the distance (2T) between the connector take-over position and the connector release position, and the first and second grippers being positioned such that, on reaching corresponding end positions, the first and second grippers release the connector housings gripped until then with the first and second grippers and firmly clamped in the connector housing guide and clamping track, and can be moved back into the starting position together out of engagement with the connector housings.

2. The device according to claim 1, wherein viewed in the advance direction of the connector housings to be assembled, a third gripper, which is movable and actuated synchronously with the first and second grippers, a distance (T) of the third gripper from the second gripper being the same as the distance (T) between the first and the second grippers.

3. The device according to claim 2, wherein the first second and third grippers are connected together by a positioning unit which is displaceable along the connector housing guide and clamping track and, during the synchronous return of the first, second and third grippers from respective end positions into respective starting positions, wherein the positioning unit is displaced away from the clamping track, and actuating means for opening the first, second and third grippers in their respective end positions for releasing connector housings grasped by the first, second or third grippers, and, in their respective starting positions, for opening and closing the first, second and third grippers in order to accommodate connector housings to be grasped thereby.

4. The device according to claim 2, wherein, viewed in the advance direction of the connector housings to be assembled, a test and sorting station is provided after the connector release position, in the continuation of the connector housing guide and clamping track, the distance (T) between the test and sorting station and the assembly station corresponding to the distance (T) between the third and the second grippers.

5. The device according to claim 1, wherein an individualizing unit is provided between the feed arrangement and the take-over position for separate, individual transfer of connector housings to be assembled into the take-over positions located after connector housings directly in the continuation of the connector housing guide and clamping track.

6. The device according to claim 1, wherein the connector housing guide and clamping track has an approximately U-shaped receiver profile with first and second side arms, the first side arm of which is pressed in urging contact against the inside of the clamping track by means of springs, for fixing connector housings in the connector housing guide and clamping track by clamping, and actuating means for moving the first and second side arms, during displacement of connector housings in the guide and clamping track by means of at least the corresponding first and second, grippers.

7. The device according to claim 1, wherein the feed arrangement, the take-over position and a removal arrangement, are constructed as a common replaceable unit wherein the removal arrangement includes a test and sorting station.

8. The device according to claim 1 for assembling connector housings with at least one electrical conductor connected electrically to a contact component, wherein the assembly unit is operatively positioned to be displaceable perpendicular to the connector housing guide and clamping track and parallel to the assembling direction, the assembly unit having an adjusting unit for controllably displacing the assembly unit by a certain amount parallel to the assembling direction, wherein a cable gripper having cable gripper jaws is mounted rotatably and swivellably on a swivel arm, about a rotational axis parallel to the assembly direction, the swivel arm being swivellably mounted on a hollow shaft that extends parallel to the assembling direction, the hollow shaft being connected to a first adjusting means for adjustably controlling swivelling of the swivel arm, the rotational axis being connected non-rotatably to the cable gripper and rotatably relative to the swivel arm via a drive transmission device having the transmission ratio of 1:1 relative to an adjusting shaft which extends through the hollow shaft, this adjusting shaft being connected to a second adjusting means for adjustably controlling swivelling of the cable gripper such that when the adjusting shaft is stationary and the hollow shaft rotates, the swivel arm swivels about the longitudinal axis of the hollow shaft with the vertical alignment of the cable gripper articulated with the swivel arm remaining unchanged.

9. The device according to claim 8, wherein the conductor receiving position of the cable gripper, the rotational axis of the, cable gripper, the assembly position and the swivel length (L) of the swivel arm, when viewed in a vertical plane running perpendicular to the assembling direction, are coordinated with one another such that when the swivel arm is idle and during rotation of the cable gripper by 90° about its rotational axis via the adjusting shaft, or during swivelling of the swivel arm via the hollow shaft, with the adjusting shaft idle, from the conductor receiver position of the cable gripper into an assembly position thereof, the contact component to be inserted into a plug-in hole of a connector housing to be assembled and connected to the electrical conductor is exactly in the longitudinal axis of the plug-in hole.

10. The device according to claim 1, wherein centering grippers for assisting in accurate insertion of a contact component into a plug-in hole to be assembled are connected to the assembly unit and, when a free face of the contact component to be inserted enters an entry opening of the plug-in hole to be assembled in a connector housing in the assembling position, the centering grippers are moved out of the further conductor advance region of the cable gripper jaws holding the conductor, and positioned in the assembly position of the cable gripper.

11. The device according to claim 1 for assembling connector housings provided with cutting-clamping contacts (IDC) with a least one individual conductor and/or at least one flat cable, wherein the cable gripper of the assembly unit are operatively connected to be displaceable perpendicular to the connector guide and clamping track and parallel to the assembling direction by means of an adjusting unit parallel to the assembling direction the adjusting unit running immediately above the cutting clamping contacts to be assembled, so as to allow insertion of the conductor down to a desired insertion depth, the cable gripper being supported displaceably and spring urgingly in the assembly unit in the conductor lowering direction (B), wherein a pressing unit is provided at the assembly position above the connector housing guide and clamping track in order to press into the contacts a conductor immediately above the cutting-clamping contacts of a connector housing to be assembled, the pressing unit when viewed in the pressing direction (C) being operatively connected to cooperate at least one of with a buffer of the cable gripper, which is displaceable parallel thereto and is spring-mounted in the assembly unit, such that after the press-in plunger has been lowered down to an upper side of the conductor to be pressed in, the cable gripper is simultaneously lowered parallel to the press-in plunger during the subsequent pressing-in operation on the conductor.

12. The device according to claim 11, wherein at least one of a pressing-in force and a pressing-in depth of the press-in plunger is adjustable.

13. The device according to claim 1, wherein control means are provided for controllably moving the assembly unit in the opposite direction to the assembly advance direction (A) with a certain test force, while the conductor inserted is held by the cable gripper, after assembly of a connector housing has taken place, withdrawal of the conductor from the plug-in hole just fitted out in the connector housing being evaluated as an error and causing subsequent sorting out of a defective connector housing.

14. The device according to claim 13, wherein at least one of a pressing-in force and a pressing-in depth of the press-in plunger is adjustable.

15. The device according to claim 1, wherein a drive provided with a stepping motor is provided for displacement of the first and second grippers parallel to the guide and clamping track.

* * * * *